US009422675B2

(12) United States Patent
Bornemann et al.

(10) Patent No.: US 9,422,675 B2
(45) Date of Patent: Aug. 23, 2016

(54) COMPACTOR

(71) Applicant: Hamm AG, Tirschenreuth (DE)

(72) Inventors: Detlef Bornemann, Leonberg (DE); Andreas Weiβ, Leonberg (DE)

(73) Assignee: Hamm AG, Tirschenreuth (DE)

( * ) Notice: Subject to any disclaimer, the term of this patent is extended or adjusted under 35 U.S.C. 154(b) by 0 days.

(21) Appl. No.: 14/812,371

(22) Filed: Jul. 29, 2015

(65) Prior Publication Data

US 2016/0053443 A1 Feb. 25, 2016

(30) Foreign Application Priority Data

Aug. 19, 2014 (DE) ..... 10 2014 216 439

(51) Int. Cl.
*E01C 19/23* (2006.01)
*E01C 19/26* (2006.01)

(52) U.S. Cl.
CPC ..... *E01C 19/238* (2013.01); *E01C 19/264* (2013.01); *E01C 19/268* (2013.01)

(58) Field of Classification Search
CPC ..... E01C 19/004; E01C 19/23; E01C 19/266; E01C 19/00; E01C 19/238; E01C 19/264; E01C 19/22; E01C 7/36; E01C 19/268; E02D 3/02
See application file for complete search history.

(56) References Cited

U.S. PATENT DOCUMENTS

| | | | | |
|---|---|---|---|---|
| 4,009,967 | A * | 3/1977 | Layton | E01C 19/238 239/223 |
| 4,187,036 | A * | 2/1980 | Haker | E01C 19/282 180/333 |
| 6,827,524 | B2 * | 12/2004 | Starry, Jr. | E01C 19/238 404/122 |
| 8,500,363 | B1 | 8/2013 | Ries et al. | |
| 8,636,443 | B2 * | 1/2014 | Ries | 239/1 |
| 8,827,593 | B1 * | 9/2014 | Oetken | E01C 19/28 404/117 |
| 2004/0018053 | A1 * | 1/2004 | Starry, Jr. | E01C 19/238 404/129 |
| 2013/0248556 | A1 * | 9/2013 | May | E02F 3/8152 222/1 |

FOREIGN PATENT DOCUMENTS

| | | |
|---|---|---|
| JP | 2004 244883 | 9/2004 |
| JP | 2007070903 | 3/2007 |
| JP | 2010090616 | 4/2010 |

OTHER PUBLICATIONS

EP search Report mailed Jan. 8, 2016.
German PTO Search Report issued Apr. 24, 2015.

* cited by examiner

*Primary Examiner* — Abigail A Risic
(74) *Attorney, Agent, or Firm* — Rankin, Hill & Clark LLP

(57) ABSTRACT

A compactor, comprising at least one compactor roller that can be rotated around a roller axis of rotation, at least one edge shaping device and a fluid reservoir/delivery system for storing and delivering fluid to at least one compactor roller and at least one edge shaping device, characterized in that the fluid reservoir/delivery system comprises at least one first fluid pump for pumping fluid to at least one first fluid delivery unit assigned to a compactor roller and at least one second fluid pump for pumping fluid to at least one second fluid delivery unit assigned to an edge shaping unit.

7 Claims, 2 Drawing Sheets

COMPACTOR

Figure 1:
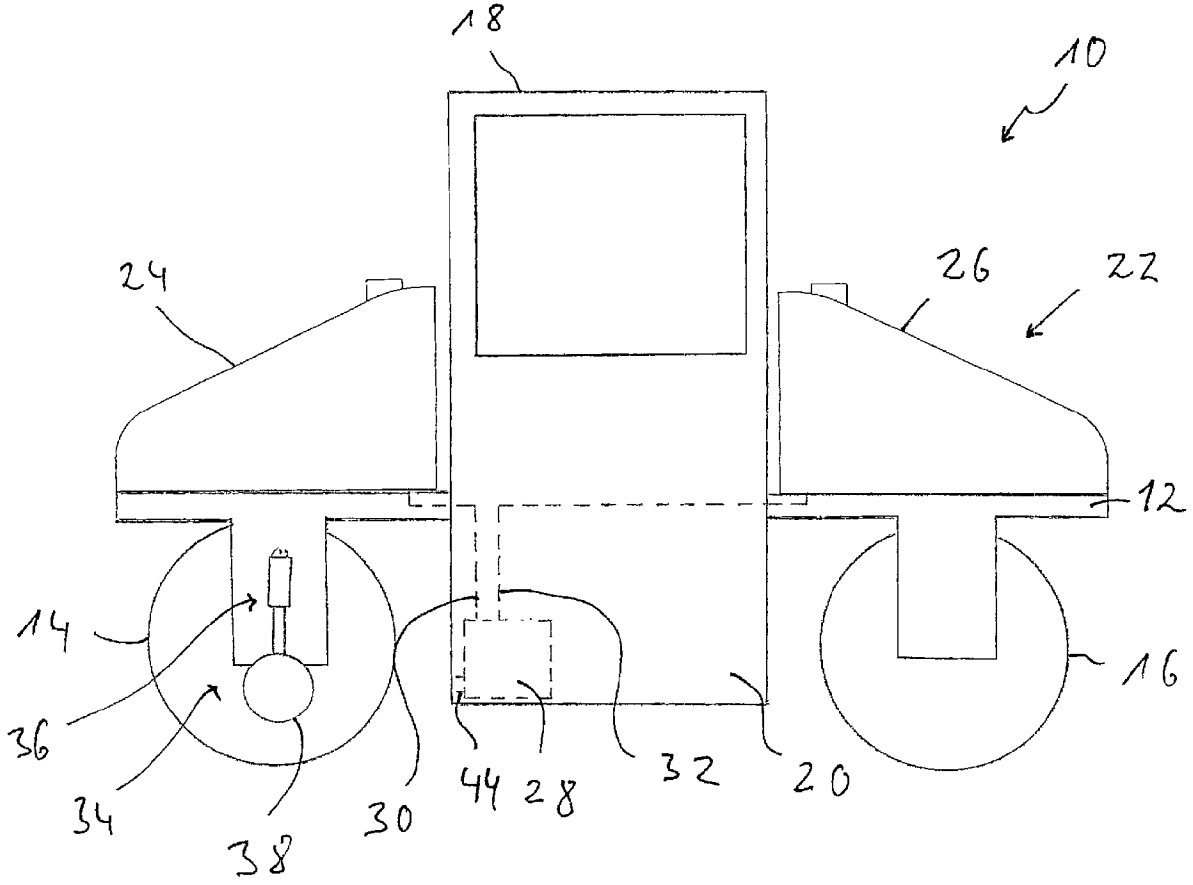

The present invention relates to a compactor, comprising at least one compactor roller that can be rotated around a roller axis of rotation, at least one edge shaping device and a fluid reservoir/delivery system for storing and delivering fluid to at least one compactor roller and at least one edge shaping device.

Such compactors, typically self-propelled compactors, are used, for example, in road construction to compact the roadbed or the road surface, in particular an asphalt surface. During the compaction of slightly adhesive materials, such as asphalt, it must be ensured that the areas of the compactor that come into contact with this material, in particular the compactor rollers, are treated in such a way that the material to be compacted does not adhere to them.

A self-propelled compactor is known from U.S. Pat. No. 8,500,363 B2, which comprises a compactor roller in a front and a rear area of a machine frame, which are provided with pneumatic tires in this design example by a group of adjacent wheels in the direction of a respective compactor roller axis of rotation. Such a group of adjacent wheels can also be considered to provide a compactor roller within the meaning of the present invention.

This known compactor has a fluid reservoir/delivery system with a fluid reservoir. By means of a pump, the fluid stored in this fluid reservoir, in this case water, is delivered to a first fluid delivery unit, by means of which the fluid is applied to the surface of one of the compactor rollers, i.e. the tires or wheels that provide this compactor roller. Furthermore, this pump delivers fluid to an edge shaping device arranged next to one of the rollers that is used to smooth or bevel the edge of a roadway being constructed of asphalt material that needs to be compacted. A second fluid delivery unit is assigned to this edge shaping device. The fluid supply to the first fluid delivery unit or the second fluid delivery unit can be interrupted by respective valves that are arranged in respective fluid delivery lines from the fluid pump to the fluid delivery units.

Because in the case of this compactor delivering fluid to the compactor roller or rollers on the one hand and the edge shaping device on the other hand is done via a joint fluid pump, there is a strong mutual dependence in the operation of these system areas to be supplied with fluid. In principle, the fluid pump must be designed in such a way that its pumping capacity is enough to supply all areas of the system at the same time. This means that when only one edge shaping device needs to be supplied with fluid, a fluid pump must be operated that is clearly oversized for this process. If the only available fluid pumps fails, neither the compactor roller nor the edge shaping device can be supplied with fluid, such that further operation of the compactor is practically impossible.

It is the object of the present invention to develop a compactor with the design specified at the outset in such a way that better operating characteristics and increased operational reliability of the fluid reservoir/delivery system are achieved with a simple design.

According to the invention, this task is solved by a compactor, comprising at least one compactor roller that can be rotated around a roller axis of rotation, at least one edge shaping device and a fluid reservoir/delivery system for storing and delivering fluid to at least one compactor roller and at least one edge shaping device.

Furthermore, the fluid reservoir/delivery system is intended to comprise at least one first fluid pump for pumping fluid to at least one first fluid delivery unit assigned to a compactor roller and at least one second fluid pump for pumping fluid to at least one second fluid delivery unit assigned to an edge shaping unit.

For the compactor designed according to the invention, the areas of the system to be supplied can therefore supply compactor roller(s) on the one hand and edge shaping device(s) on the other with fluid independently by means of autonomously operable fluid pumps. On the one hand, this permits the sizing of the fluid pumps assigned to these different areas of the system such that they are designed for the required amount of fluid, thus making it possible to avoid oversizing. On the other hand, there is no reciprocal interaction during operation, which also increases operating safety because, for example, a defect of a second fluid pump does not affect the supply of fluid to the compactor roller or rollers.

To make it as simple as possible to design the fluid line system for the compactor according to the invention, it is proposed that at least one first fluid pump and at least one second fluid pump be connected in parallel. In particular, the design can be such that at least one first fluid pump and at least one second fluid pump absorb fluid from an intermediate fluid line and that the at least one first fluid pump delivers fluid to a first fluid delivery line that leads to at least one first fluid delivery unit and the at least one second fluid pump delivers fluid into a second fluid line that leads to at least one second fluid delivery unit. All fluid pumps can thus absorb fluid through a common intermediate fluid line and then separately deliver it via respective delivery lines to the areas of the system to be supplied.

Because the supply of the compactor roller(s) with fluid in particular is of exceptional importance, it is proposed that two first fluid pumps and one second fluid pump be provided. If a first fluid pump fails, fluid can then be pumped to the compactor roller or rollers via the other first fluid pump and the compaction operation of a compactor when compacting asphalt can thus be continued. Because the failure of the fluid supply to the edge shaping device or devices does not have a fundamental impact on the operation of the compactor, as is the case for the fluid supply to the compactor rollers, the design of the entire system can be kept simple and compact by providing only one second fluid pump, that is, avoiding redundancy in this area.

The provision of independently operable fluid pumps assigned to the compactor roller or rollers on the one hand and to the edge shaping device or devices on the other hand provides the possibility to design or dimension these fluid pumps independently of each other as well. Because a greater need for fluid generally exists for the compactor roller or rollers, it can therefore be provided that at least one second fluid pump has a lower maximum output than at least one first fluid pump.

To be able to store a sufficient amount of fluid in the compactor according to the invention on the one hand, but ensure suitable delivery to the areas of the system to be supplied on the other hand, it is proposed that the fluid reservoir/delivery system comprises at least one main fluid reservoir and an assigned main fluid line that leads to an intermediate fluid reservoir. In particular, it can be provided that the intermediate fluid line leads from the intermediate fluid reservoir to at least one first fluid pump and at least one second fluid pump.

According to another especially advantageous aspect, it is proposed that at least one main fluid reservoir, preferably all of them, can be filled and emptied via these assigned main fluid lines. In particular, it may be thereby provided that a filling port to fill at least one fluid main reservoir connected to the intermediate fluid reservoir is assigned to it via the intermediate fluid reservoir. In this way, the filling process, for example, can be performed quickly and easily as a pressure filling process.

Furthermore, the compactor according to the invention is preferably designed with two compactor rollers, each compactor roller being assigned to a fluid delivery unit. According to another very advantageous aspect, one main fluid reservoir can be arranged above each compactor roller such that even weight distribution in the compactor can be ensured.

If two compactor rollers are provided for the compactor designed according to the invention, an edge shaping device can advantageously be provided that is assigned to each compactor roller. To shape the respective edge of a roadway to be constructed in both side areas it is also proposed that the edge shaping devices be provided on different sides of the compactor in the direction of the compactor roller axes of rotation in this case. When the compactor moves in a first direction of travel, a first edge shaping device can therefore be used to shape the roadway edge. If the compactor moves in the opposite direction, the edge shaping device provided on its other side can be used to shape the other edge of the road.

Figure 2:
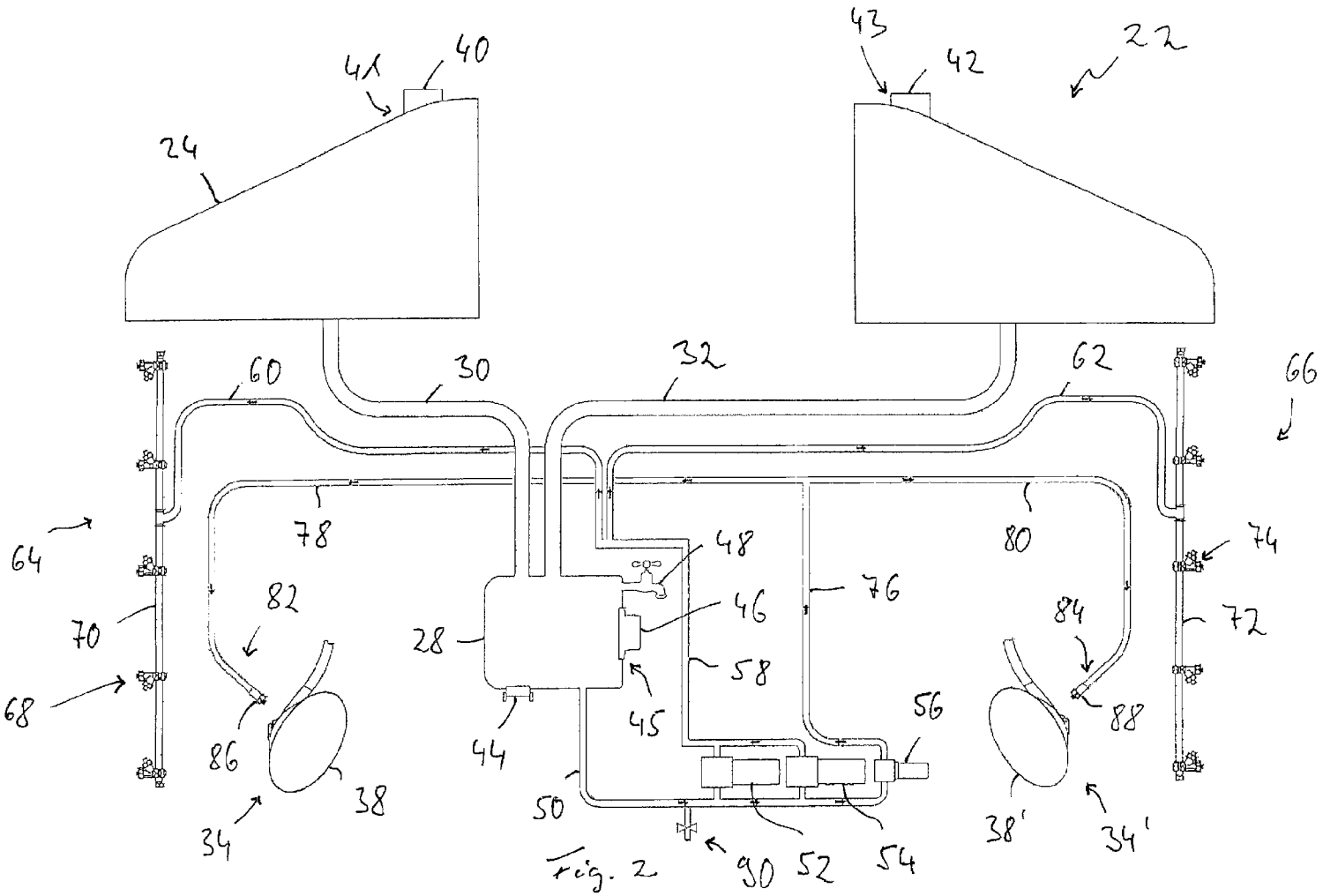

The present invention is described below in detail in reference to the enclosed figures. Shown are:

FIG. 1 a compactor having two compactor rollers on a machine frame in a sketched side view;

FIG. 2 a fluid reservoir/delivery system for the compactor shown in FIG. 1.

In FIG. 1, a self-propelled compactor 10 that can be used, for example, to compact asphalt material for a roadway is shown in a sketched illustration in a side view. The compactor 10 comprises, for example, a machine frame 12 in the form of a hinged frame to which are attached two compactor rollers 14, 16 that can be rotated around respective compactor roller axes of rotation. The two compactor rollers 14, 16 are arranged in succession on the machine frame 12 in the direction of movement of the compactor 10. For example, one of them can be provided on a front end and one of them on the rear end of the machine frame. In this context it should be noted that each of the compactor rollers 14, 16 can be designed within the meaning of the present invention as a roller constructed with a roller shell made of steel material that continues in the direction of the compactor roller axis of rotation. However, one or both of the compactor rollers 14, 16 could also be designed with a plurality of wheels that are aligned in succession in the direction of the respective compactor roller axis of rotation, for example, with pneumatic tires, which then collectively define a compactor roller within the meaning of the present invention. In principle, however, every wheel of such a group of adjacent wheels could be considered a compactor roller within the meaning of the present invention.

In the area between the two compactor rollers 14, 16, a cab 18 is provided on the machine frame 12. An operator can control the compactor 10 during a work operation from the cab 18. In an area 20 under the cab 18, the drive unit, for example, a diesel drive unit, can be attached to the machine frame 12. The various system areas of the compactor 10 to be driven can be supplied with the appropriate operating power via this drive unit, for example, via a compressed fluid circuit, a generator/motor or something similar.

The compactor 10 comprises a fluid reservoir/delivery system that is generally designated 22. Two main fluid tanks 24, 26, each of which is positioned above a compactor roller 14, 16 on the machine frame 12, are evident in FIG. 1. from this fluid reservoir/delivery system, the structure and function of which is described below with reference to FIG. 2. Furthermore, intermediate fluid reservoir 28 is diagrammed in FIG. 1 and is attached to the machine frame 12 in the area 20 under the cab 18, that is, in the area in which the drive unit can also be located. Furthermore, main fluid lines 30, 32 leading from the main fluid reservoirs 24, 25 to the intermediate fluid reservoir 28 are evident. The fluid contained in the main fluid reservoirs 24, 26 can be delivered to the intermediate fluid reservoir 28 via the main fluid lines 30, 32 and then be supplied in the manner described below to the system areas of the compactor 10 to be supplied with fluid. The areas of the system comprise the two compactor rollers 14, 16 whose surfaces must be wet with fluid during an asphalt compaction process to prevent the asphalt material from adhering to the compactor rollers 14, 16. Another area of the system to be supplied with fluid, for example water, is shown in FIG. 1 assigned to compactor roller 14. This area of the system comprises an edge shaping device 24 that is arranged laterally next to compactor roller 14 and can be used to shape an edge of the roadway. This edge shaping device 34 comprises an edge shaping wheel 38 that can be adjusted in height, for example, by a hydromechanical drive 36, in the form of a bevel wheel and can press and bevel the edge of the road to be shaped while in contact with it. The edge shaping wheel 38 can be brought to a suitable height position for performing such an edge shaping procedure and be driven for rotation. The compactor 10 can have two such edge shaping devices 34, each on one side of it viewed in the direction of the compactor roller axes of rotation. For example, it can be provided that the compactor roller 16 provided at the other end area of the machine frame 12 on the side of the compactor 10 that is not seen in FIG. 1 is also assigned such an edge shaping device such that an edge region can be shaped with the assigned edge shaping device regardless of the orientation or direction of movement of the compactor 10.

The structure and function of the fluid reservoir/delivery system 22 is described below with reference to FIG. 2.

In FIG. 2, the two main fluid reservoirs 24, 26 are evident, each of which can have an opening 41, 43 in their upper area that can be closed off by a closure 40, 42, e.g. a screw cap. On the one hand, these openings 41, 43 or the associated closure 40, 42 can be used to vent the respective main fluid reservoir 24, 26 in a filling process. On the other hand, the main fluid reservoirs 24, 26 can also be filled in principle via these openings 41, 43 when the closure 40, 42 is removed.

The main fluid line 30 that leads from the lower area of the main fluid reservoir 24 to the intermediate fluid reservoir 28, which is assigned to the main fluid reservoir 24, is also evident in FIG. 2. Accordingly, the main fluid line 32 assigned to the main fluid reservoir 26 leads from a lower area of the main fluid reservoir 26 to the intermediate fluid reservoir 28. It can be seen that the two main fluid lines 30, 32 flow into the intermediate fluid reservoir 28 in its upper section. Because the intermediate fluid reservoir 28 is arranged vertically under both main fluid reservoirs 24, 26, it is ensured that the main fluid reservoirs 24, 26 can be fully emptied into the intermediate fluid reservoir 28 via the main fluid lines 30, 32.

The intermediate fluid reservoir 28 is also assigned a filling connection 44 that is provided in a lower area of the reservoir. This filling connection 44, which is designed, for example, as an inclined connector or pressure pipe connector, preferably a so-called C pipe connector, can be used to fill the two main fluid reservoirs 24, 26 via the intermediate fluid reservoir and the main fluid lines 30, 32 that lead to it. This means that the main fluid line 30 or 32 assigned to a respective main fluid reservoir 24 or 26 can not only be used to empty the main fluid reservoir 24 or 26 but also to fill it. Because the filling connection 44 is designed in such a way that it is suited for pressure filling, it is possible to fill the two main fluid reservoirs parallel to each other in a very short time. The air displaced from the main fluid reservoirs 24, 26 can escape via the openings 41, 43 provided in the upper area of these main fluid reservoirs 24, 26 or the closures 40, 42 assigned to them that have respective ventilation arrangements.

A fluid drainage opening 45 that can be closed off using a closure 46 is provided on the intermediate fluid reservoir 28, which can, for example, take the form of a rotation injection-molded part made of plastic material, preferably PE material, and secured to the machine frame 12 by means of a tensioning strap Fluid contained in the main fluid reservoirs 24, 26 or the main fluid lines 30, 32 can be drained via this fluid drainage opening 45. Furthermore, a fluid filter arrangement can be attached to the closure 46 that closes off the fluid drainage opening 45, which may be configured as a screw cap, such that it can easily be removed from the intermediate fluid reservoir 28 and cleaned when the closure 46 is removed.

A fluid delivery element 48 in the form of, for example, a faucet is also provided on the intermediate fluid reservoir 28. This can be used by staff working in the area of the compactor 10 to wash their hands with the fluid stored in the main fluid reservoirs 24, 26 or in the intermediate fluid reservoir 28.

The intermediate fluid reservoir 28 can also be assigned a fill level detection assembly. This can operate in the intermediate fluid reservoir 28, for example, in a pressure-dependent manner such that it is possible to determine the extent to which the main fluid reservoirs 24, 26 positioned vertically above the intermediate fluid reservoir 28 are filled with fluid based on the recorded fluid pressure.

To ensure that the fluid contained in the intermediate fluid reservoir 28 or the main fluid reservoirs 24, 26 does not drain via the filling connection again after carrying out a pressure filling process via the filling connection 44 and removing a hose that is used for pressure filling and connected to the filling connection 44, the filling connection 44 is preferably assigned a valve arrangement, preferably a non-return valve arrangement that ensures only an influx of fluid into the intermediate fluid reservoir 28, but prevents fluid from escaping from the intermediate fluid reservoir 28 through the filling connection 44. Fluid can, as set out above, be drained via the fluid drainage opening 45 that is closed off by the closure 46.

From the lower area of the intermediate fluid reservoir 28, an intermediate fluid line 50 leads away to two first fluid pumps 52, 54 and a second fluid pump 56. These three fluid pumps 52, 54, 54 are connected to the intermediate fluid line 50 parallel to each other and therefore absorb fluid from the intermediate fluid line 50 parallel to each other. The two first fluid pumps 52, 54 are connected parallel to each other also to a first fluid delivery line 58. The first fluid delivery line 58 leads away from the two first fluid pumps 52, 54 and branches off into two first branch lines 60, 62. Each first branch line 60, 62 leads to a respective first fluid delivery unit 64, 66. The first fluid delivery unit 64 is assigned to the compactor roller 14 and comprises a plurality of fluid delivery nozzles 68 placed in succession in the direction of the compactor roller axis of rotation that spray fluid onto the surface of the compactor roller 14 in the pumping mode of the first fluid pumps 52 or 54. These can be provided on a distributor pipe 70 positioned along the compactor roller 14 preferably above a stripper assigned to compactor roller 14. The fluid sprayed onto the compactor roller 14 through the fluid delivery nozzles 68 in an area above the strippers is additionally distributed by the stripper located on the surface of the compactor roller 14 such that a full-surface wetting of the compactor roller 14 with the fluid delivered by the first fluid delivery unit 64 is ensured.

Similarly, the first fluid delivery unit 66 is assigned to the other compactor roller 16. This first fluid delivery unit 66 that works together with the compactor 16 comprises a distributor pipe 72 that preferably extends above a stripper assigned to compactor roller 16 with a plurality of provided fluid delivery nozzles 74.

In compaction mode, the fluid contained in the main fluid reservoirs 24, 26 and running via the main fluid lines 30, 32 into the intermediate fluid reservoir 28 by gravity through one of the two first fluid pumps 52, 54 via the intermediate fluid line 50 can be pulled out of the intermediate fluid reservoir 28 and pumped to the first fluid delivery units 64, 66 via the first fluid delivery line 58 and the two first branch lines 60, 62. The dimensioning of the first fluid pumps 52, 54 is selected in such a way that each one has sufficient pumping capacity to supply both fluid delivery units 64, 66 with enough fluid. The provision of two first fluid pumps 52, 54 connected to each other in parallel ensures that work can continue with the other pumps in case one of them fails such that an interruption in the fluid supply to the two fluid delivery units 64, 66 can be avoided.

The fluid pump 56 that also takes fluid out of the intermediate fluid reservoir 58 via the intermediate fluid line 50 delivers the fluid the reservoir requires to a second fluid delivery line 76. The second fluid delivery line 76 branches off into two second branch lines 78, 80. Each second branch line 78, 80 leads to a second fluid delivery unit 82 or 84. Each of these second fluid delivery units 82 to 84 can comprise one or more fluid delivery nozzles 86, 88. The fluid pumped from the second fluid pump 56 can be delivered via the fluid delivery nozzles 86, 88 toward a respective edge shaping device 34 or 34'. For example, the fluid can be sprayed onto the respective edge shaping wheel 38 or 38' of the edge shaping device 34 or 34' while the wheel rotates around an axis of rotation in an edge shaping operation. As already mentioned previously, each of these two edge shaping devices 34, 34' can be assigned to one of the two compactor rollers 14, 16, preferably distributed on the two sides of the compactor 10.

Fluid can be pumped to the second fluid delivery units 82, 84 by the second fluid pump 56, which is connected to the two first fluid pumps 52, 54 in parallel, regardless of the operation of the first fluid pump 52, 54, and specifically with the required or preferred amount. Because significantly less fluid needs to be pumped in general to the edge shaping devices 34, 34' during edge shaping than is required for the two compactor rollers 14, 16, the second fluid pump 56 can be designed with a lower maximum output, that is, flow volume per unit of time, than the two first fluid pumps 52 54. Significantly less energy must be used to pump fluid as a result if a fluid supply to the two first fluid delivery units 64, 66 is not required during an edge shaping procedure because only a relatively small-sized fluid pump, namely the second fluid pump 56, is to be operated. Furthermore, the second fluid pump 56 can also be designed or controlled for a different pumping mode, for example, an intermittent pumping mode.

To be able to drain the pipelines below the drainage opening 45, in particular if the fluid pumps 52, 54, 56 are arranged vertically under the intermediate fluid reservoir 28, a connection 90 that can be closed off by a valve or a faucet can, for example, lead away from the intermediate fluid line 50 or from the lowest pipeline, through which the fluid can drain when the valve or faucet is open. Anti-freeze, for example, can also be fed into the pipe system via this connection 90 to pump it to the various fluid delivery nozzles 68, 74, 86, 88, for example, during a short pumping operation of the fluid pumps 52, 54, 56. This ensures that when the compactor 10 is shut down at low ambient temperatures, for example overnight, the fluid still present in the area of the fluid delivery nozzles 68, 74, 86, 88 or the pipelines leading to it does not freeze.

The compactor 10 described previously with reference to FIGS. 1 and 2 includes a variety of aspects that are especially advantageous in combination, but also effective on their own. On the one hand, this is the possibility to fill one or more main fluid reservoirs 24, 26 via a filling connection 44 that is assigned to them together, in particular when a pressure filling process is carried out, to which end the aspect that the main fluid lines 30, 32 can not only be used to drain the main fluid reservoirs 24, 26, but also to fill them is utilized. Another very advantageous aspect of the compactor 10 according to the invention is the fact that the various system areas to be supplied with fluid, generally water, in which there are different requirements with respect to the required amount of water, namely the compactor rollers 14, 16 on the one hand and the edge shaping devices 34, 34' on the other, can be supplied independently through first fluid pumps 52, 54 or a second fluid pump 56 that are assigned to these system areas. Each of these system areas or each of these pumps 52, 54, 56 can therefore be built with design aspects optimal for the respective mode, in particular with a sufficient maximum pumping capacity, without resulting in impairment of the functionality in the fluid supply to a different system area.

It should be noted that the aspect that both main fluid reservoirs 24, 26 can be filled via a joint filling connection 44 is also possible if each main fluid reservoir 24, 26 is assigned multiple, for example two, main fluid lines. A main fluid line could then, for example, lead from each main fluid reservoir 24, 26 to the intermediate fluid reservoir 28, while another main fluid line could lead to the filling connection 44 that is not provided on the intermediate fluid reservoir 28 such that the main fluid reservoirs 24, 26 can be filled together via these additional main fluid lines.

The invention claimed is:

1. A compactor comprising:

at least one compactor roller that can be rotated around a roller axis of rotation, at least one edge shaping device, a fluid reservoir/delivery system for storing and delivering fluid to at least one compactor roller and at least one edge shaping device, wherein the fluid reservoir/delivery system comprises two first fluid pumps for pumping fluid to at least one first fluid delivery unit assigned to a respective compactor roller and one second fluid pump for pumping fluid to at least one second fluid delivery unit assigned to a respective edge shaping unit, wherein the two first fluid pumps are connected parallel to each other for delivering fluid to a common first fluid delivery line supplying fluid to each of the at least one first fluid delivery unit, and wherein the second fluid pump delivers fluid into a second fluid line supplying fluid to the at least one second fluid delivery unit.

2. The compactor according to claim 1, wherein the two first fluid pumps and the second fluid pump absorb fluid from an intermediate fluid line.

3. The compactor according to claim 1, wherein the at least one second fluid pump has a lower maximum output than the at least one first fluid pump.

4. The compactor according to claim 1, wherein the fluid reservoir/delivery system comprises at least one main fluid reservoir and a main fluid line assigned to each at least one main fluid reservoir, each main fluid line leads to an intermediate fluid reservoir.

5. The compactor according to claim 4, wherein an intermediate fluid line leads from the intermediate fluid reservoir to the at least one first fluid pump and the at least one second fluid pump.

6. The compactor according to claim 4, wherein:

the at least one main fluid reservoir is filled and drained via the main fluid lines, or the intermediate fluid reservoir is assigned a filling connection for filling the at least one main fluid reservoir via the intermediate fluid reservoir, or two compactor rollers are provided, each compactor roller being assigned a fluid delivery unit or a main fluid reservoir being arranged above each compactor roller.

7. The compactor according to claim 1, wherein two compactor rollers are provided, a respective edge shaping device being provided and assigned to each compactor roller on different sides of the compactor in the direction of the compactor roller axes of rotation.

* * * * *